US008615891B2

(12) United States Patent
Psimadas et al.

(10) Patent No.: US 8,615,891 B2
(45) Date of Patent: Dec. 31, 2013

(54) RAZOR WITH A RETRACTABLE SHAVING CARTRIDGE AND RAZOR HANDLE FOR SUCH A HANDLE

(75) Inventors: Ioannis Marios Psimadas, Vrilissia-Athens (GR); Ioannis Bozikis, Koukaki-Athens (GR); Jim Blyth, Farnham-Surrey (GB); Matt Plested, Churt Farnham (GB); Tan Tran, Petersfield (GB)

(73) Assignee: BIC-Violex SA, Attiki (GR)

( * ) Notice: Subject to any disclaimer, the term of this patent is extended or adjusted under 35 U.S.C. 154(b) by 301 days.

(21) Appl. No.: 13/119,639

(22) PCT Filed: Sep. 18, 2008

(86) PCT No.: PCT/EP2008/062474
§ 371 (c)(1), (2), (4) Date: Mar. 17, 2011

(87) PCT Pub. No.: WO2010/031435
PCT Pub. Date: Mar. 25, 2010

(65) Prior Publication Data
US 2011/0167653 A1 Jul. 14, 2011

(51) Int. Cl.
*B26B 21/22* (2006.01)
*B26B 21/52* (2006.01)

(52) U.S. Cl.
USPC ..... 30/526; 30/534

(58) Field of Classification Search
USPC ..... 30/34.1, 50, 51, 526–536
See application file for complete search history.

(56) References Cited

U.S. PATENT DOCUMENTS

| | | | | |
|---|---|---|---|---|
| 5,009,004 | A * | 4/1991 | Yen | 30/47 |
| 5,608,972 | A | 3/1997 | Tsae-Chyn | |
| 6,581,290 | B1 * | 6/2003 | Fishel | 30/526 |
| 6,928,738 | B2 * | 8/2005 | Segrea | 30/34.1 |
| 8,015,711 | B2 * | 9/2011 | Psimadas et al. | 30/34.1 |
| 2003/0121154 | A1 * | 7/2003 | Orloff et al. | 30/41 |
| 2004/0118724 | A1 | 6/2004 | Leventhal et al. | |
| 2011/0023310 | A1 * | 2/2011 | Psimadas et al. | 30/526 |
| 2011/0030228 | A1 * | 2/2011 | Rees et al. | 30/536 |
| 2011/0030229 | A1 * | 2/2011 | Psimadas et al. | 30/536 |

FOREIGN PATENT DOCUMENTS

| | | | |
|---|---|---|---|
| EP | 0278272 | A1 | 8/1988 |
| EP | 0 403 839 | A1 | 12/1990 |
| EP | 0 469 278 | A1 | 2/1992 |
| JP | 63-200790 | | 8/1988 |
| JP | 2007-529251 | | 10/2007 |
| WO | WO 2005/090016 | A1 | 9/2005 |
| WO | WO 2005-090017 | A1 | 9/2005 |

* cited by examiner

*Primary Examiner* — Stephen Choi
(74) *Attorney, Agent, or Firm* — Jones Day

(57) ABSTRACT

A razor including an elongated shaving cartridge that has at least one blade with a blade edge extending along a transversal axis. The razor includes a razor handle with a handle body having a hollow housing with an opening at its front end and a cartridge carrier that carries the shaving cartridge and is slidably mounted on the handle body between shaving and non-shaving positions. The razor handle also includes an actuator rotatably mounted on the handle body for controlling cartridge carrier motions, and a transmission mechanism that converts actuator rotation into a sliding motion of the cartridge carrier. The opening of the handle body is elongated, with a length sufficient to accommodate the shaving cartridge with the blade edge extending along the transversal axis. In both the shaving and non-shaving positions, and while between the shaving and non-shaving positions, the shaving cartridge extends parallel to the transversal axis.

18 Claims, 13 Drawing Sheets

RAZOR WITH A RETRACTABLE SHAVING CARTRIDGE AND RAZOR HANDLE FOR SUCH A HANDLE

CROSS REFERENCE TO RELATED APPLICATION

This application is a national stage application of International Application No. PCT/EP2008/062474 ("the '474 Application"), filed on Sep. 18, 2008, the entire contents of the '474 Application being incorporated herein by reference.

FIELD OF THE INVENTION

The invention is concerned with razors with retractable shaving cartridges and razor handles for such a razor.

BACKGROUND OF THE EMBODIMENTS OF THE PRESENT INVENTION

In the known razors, like those disclosed in EP0469278A1, when the shaving cartridge is located inside the handle body, the shaving cartridge extends parallel to the longitudinal direction of the handle body. Therefore, when a user wants to shave, after having slid the shaving cartridge out of the handle body, he has to turn the shaving cartridge in order to put it in the shaving position where it extends perpendicular to the longitudinal direction. Similarly, after shaving, the user has to turn the shaving cartridge in order to put it parallel to the longitudinal direction and be able to slide it inside the handle body.

Therefore, the use of such a razor is cumbersome. Further, these known razors may be dangerous for the user, especially because he can cut himself with the blade edge when he turns the shaving cartridge from the non-shaving position to the shaving position and vice-versa. The embodiments of the present invention described in this application improve upon razors with retractable shaving cartridges by solving the aforementioned drawbacks.

SUMMARY OF THE EMBODIMENTS OF THE PRESENT INVENTION

An embodiment of the present invention is directed to a razor having an elongated shaving cartridge that includes at least one blade, which has a blade edge extending along a transversal axis. Further, the razor includes a razor handle with a handle body extending in a longitudinal direction between a front end and a back end, the handle body having a hollow housing provided with an opening at its front end, where the longitudinal direction is perpendicular to the transversal axis. Additionally, the razor handle includes a cartridge carrier that carries the shaving cartridge and is slidably mounted on the handle body between a shaving position (in which the shaving cartridge extends at least partly out of the housing) and a non-shaving position (in which the shaving cartridge is retracted inside of the housing). The razor handle also includes an actuator rotatably mounted on the handle body for controlling cartridge carrier motions, and a transmission mechanism adapted to convert a rotation of the actuator into a sliding motion of the cartridge carrier. The opening of the handle body is elongated, extends along the transversal axis, and has a length which is sufficient to accommodate the shaving cartridge with the blade edge extending along the transversal axis. Additionally, in both the shaving and non-shaving positions, as well as during a motion of the shaving cartridge between the shaving and non-shaving positions, the shaving cartridge extends parallel to the transversal axis.

Another embodiment of the present invention is directed to a razor handle including a handle body extending in a longitudinal direction between a front end and a back end. The handle body includes a hollow housing with an opening at the front end of the handle body. The razor handle further includes a cartridge carrier that is adapted to carry a shaving cartridge and is movable between a shaving position (in which the razor cartridge carrier extends at least partly out of the housing) and a non-shaving position (in which the razor cartridge carrier is retracted inside the housing). Additionally, the razor handle includes an actuator that is rotatably mounted on the handle body for controlling cartridge carrier motion, and a transmission mechanism adapted to convert a rotation of the actuator into a sliding motion of the cartridge carrier. Further, the razor handle includes a lock/release mechanism provided on the cartridge carrier. The lock/release mechanism includes an actuating member which is adapted to actuate a release mechanism so as to release a shaving cartridge carried by the cartridge carrier.

BRIEF DESCRIPTION OF THE DRAWINGS

Preferred features of embodiments of the present invention are disclosed in the accompanying drawings, wherein similar reference characters denote similar elements throughout the several views, and wherein.

DETAILED DESCRIPTION OF THE EMBODIMENTS OF THE PRESENT INVENTION

Figure 1A:
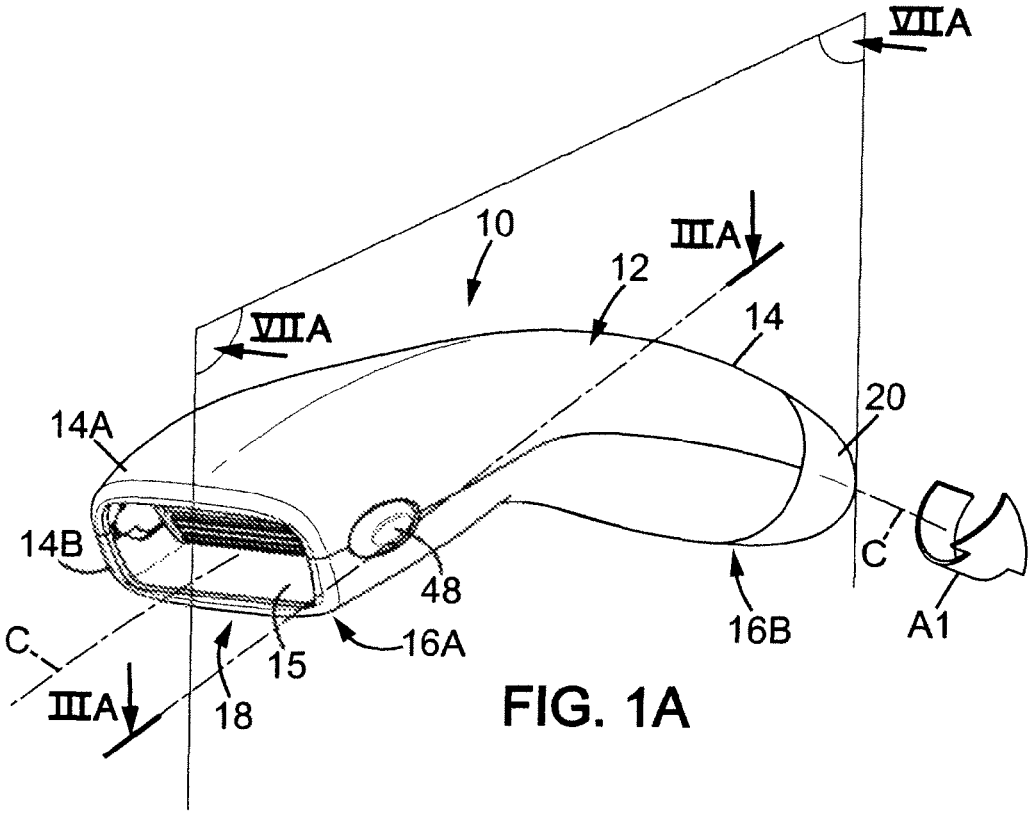
FIG. 1A is a perspective view of a shaving razor according to an embodiment of the invention in a non-shaving position.

The present invention will now be described more fully hereinafter with reference to the accompanying drawings, in which preferred embodiments of the invention are shown. This invention may, however, be embodied in many different forms and should not be construed as limited to the illustrated embodiments set forth herein.

In the following description, like reference characters designate like or corresponding parts throughout the figures. Additionally, in the following description, it is understood that terms such as "front," "back," "first," "second," and the like, are words of convenience and are not to be construed as limiting terms.

Figure 1B:
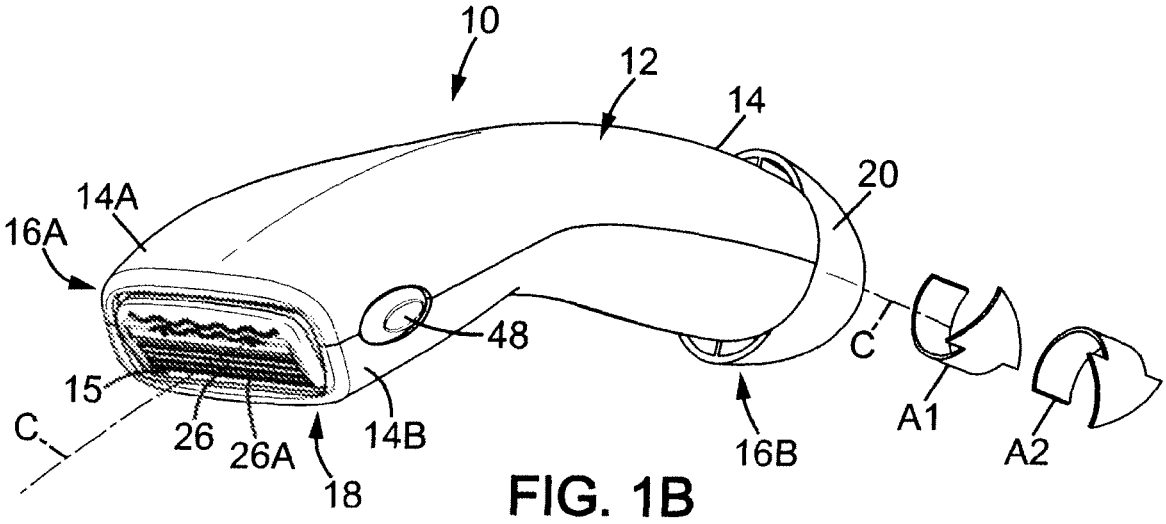
FIG. 1B is a perspective view of a shaving razor according to an embodiment of the invention in an intermediate position.
Figure 2:
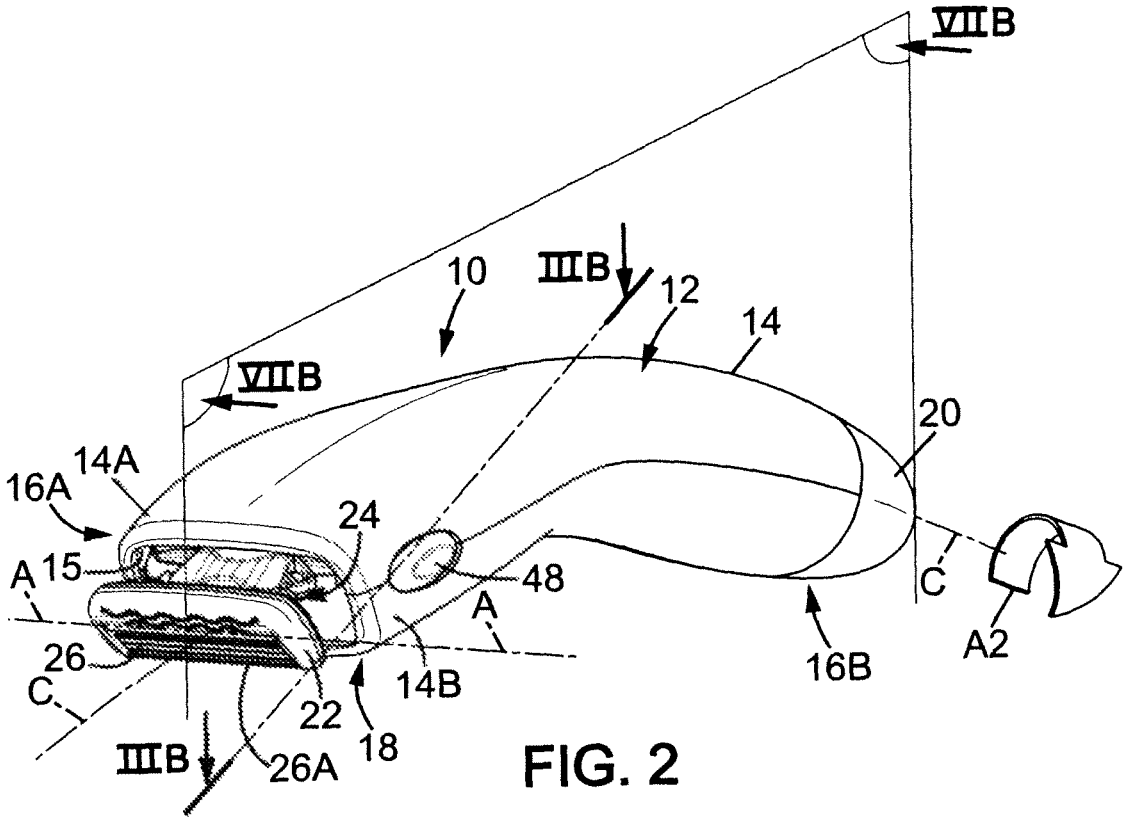
FIG. 2 is a perspective view of a shaving razor according to an embodiment of the invention in a shaving position.

FIGS. 1A, 1B and 2 illustrate a razor 10 including a razor handle 12 having a handle body 14 that includes an upper shell 14A and a lower shell 14B. When assembled, these two shells 14A and 14B define an internal space forming a hollow housing 15 in the handle body 14. The handle body 14 extends in a longitudinal direction C-C between a front end 16A and a back end 16B. The handle body 14 is further provided on its front end 16A with an opening 18 allowing access to hollow housing 15.

The razor handle 12 further includes an actuator 20 rotatably and lockingly mounted on the handle body 14 to allow for the extension and the retraction of a shaving cartridge 22 connected to the razor handle 12. More specifically, and as depicted in FIG. 2, the razor handle 12 further includes a cartridge carrier 24 able to carry the shaving cartridge 22 and slidably mounted on the handle body 14 between a non-shaving position in which the shaving cartridge 22 is retracted inside the housing 15 (as illustrated on FIG. 1A) and a shaving position, in which the shaving cartridge 22 extends at least partly, more preferably completely out of the housing 15 (as illustrated on FIG. 2). Such a razor handle as described in the embodiments of the present invention allows a shaving cartridge connected to the cartridge carrier to be located inside the housing when the razor in not used, hence protecting the shaving cartridge from any aggressive environment.

The shaving cartridge 22 is provided with one or more blades 26 each having a blade edge 26A extending along a transversal axis A-A perpendicular to the longitudinal direction C-C. In fact, the shaving cartridge 22 is elongated and extends along the transversal axis A-A.

Beginning from the non-shaving position (0°) as illustrated in FIG. 1A, when turning the actuator 20 in one direction, for instance along arrow A1, the cartridge carrier 24 begins to slide while being pushed forward in direction of the front end 16A of the handle body 14, as explained in details hereafter, and the shaving cartridge 22 begins to extend out of the housing 15. In one embodiment, when turning the actuator 20 in the same direction along arrow A1 up to about 90° (or a quarter-turn from the non-shaving position), the shaving cartridge 22 is located partly outside the housing 15 as illustrated in FIG. 1B, but the cartridge carrier 24 is in its intermediate position and has not yet arrived to the shaving position illustrated on FIG. 2.

From this intermediate position illustrated on FIG. 1B, when turning the actuator 20 of a one more quarter-turn in the same direction along arrow A1 (half a turn or 180° from the beginning in the non-shaving position), the cartridge carrier 24 is arrived to its shaving position as illustrated on FIG. 2 and the shaving cartridge 22 is located out of the housing 15, able to be used for shaving.

From the shaving position illustrated on FIG. 2, when turning back the actuator 20 a quarter-turn, i.e., turning the actuator 20 in the opposite direction along arrow A2 (90° from the initial non-shaving position depicted in FIG. 1A), the cartridge carrier 24 begins to retract back into the housing 15, as illustrated on FIG. 1B, and is being pulled rearward in the direction of the back end 16B of the handle body 14.

From the intermediate position illustrated in FIG. 1B, when turning the actuator 20 one more quarter-turn in the same direction along arrow A2 (0° from the initial non-shaving position depicted in FIG. 1A), the cartridge carrier 24 has arrived back to its non-shaving position as illustrated in FIG. 1A and the shaving cartridge 22 is located inside of the housing 15. The actuator 20 can be turned in the same direction along arrow A1 to extract and retract the cartridge carrier 24 or can be turned in an opposite direction (opposite to arrow A1) between the shaving and non-shaving positions, and vice-versa.

During the full range of motion of the cartridge carrier 24, the shaving cartridge 22, and more precisely the blades edges, always extend along the transversal axis A-A. In fact, there is no need for a user to act on the shaving cartridge 22. When the cartridge carrier 24 slides along the longitudinal direction C-C, the shaving cartridge 22 also slides along the longitudinal direction C-C while staying continuously perpendicular to the longitudinal direction C-C.

From the shaving position illustrated in FIG. 2, in order to bring the shaving cartridge 22 into the housing 15 in the non-shaving position without having to turn the shaving cartridge 22, the opening 18 is elongated and extends along the transversal axis A-A, more precisely along an axis parallel to the transversal axis A-A.

Figure 3A:
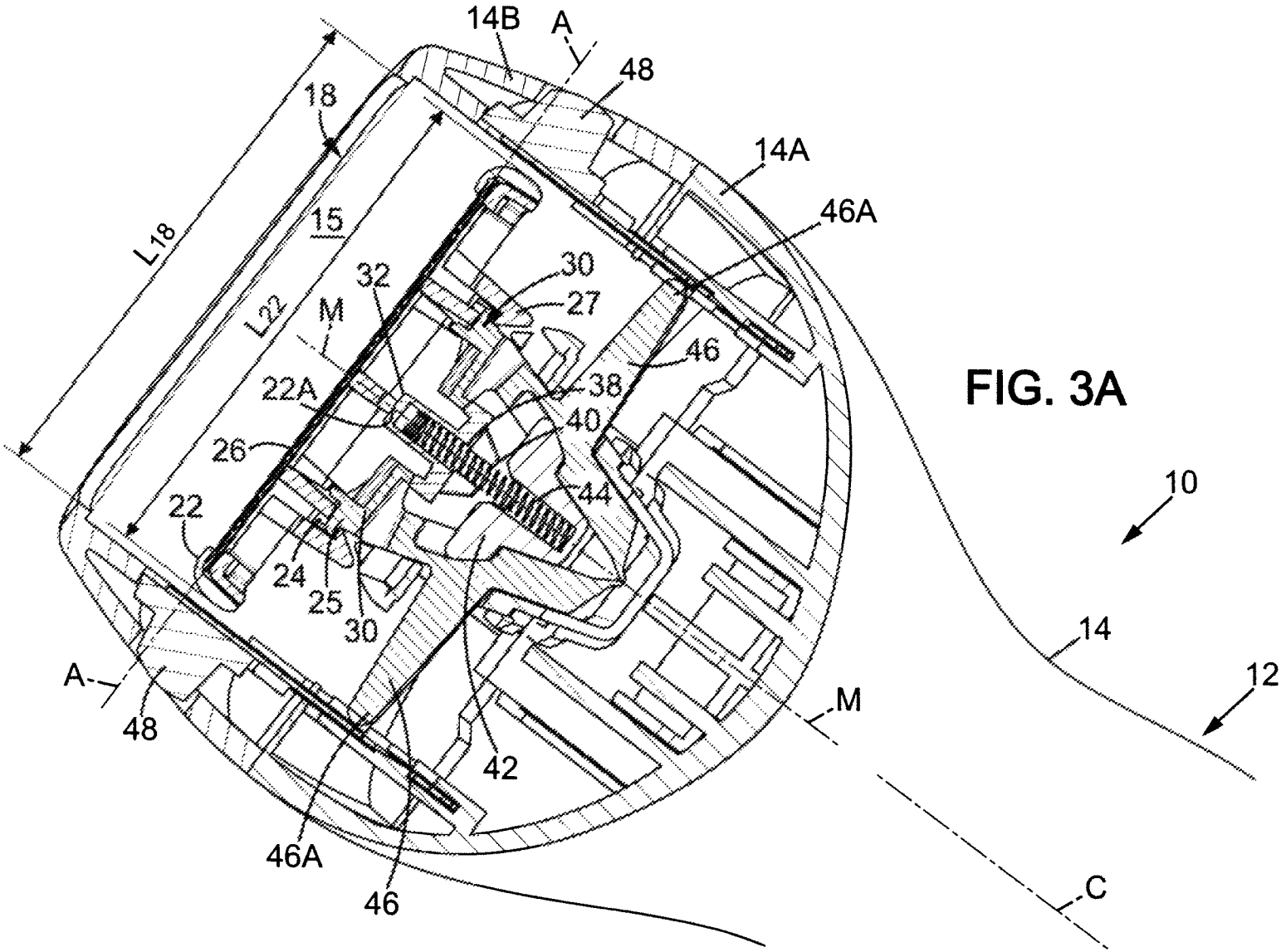
FIG. 3A is a partial cross-sectional view of the front end of the shaving razor shown in FIG. 1A along line IIIA-IIIA.
Figure 3B:
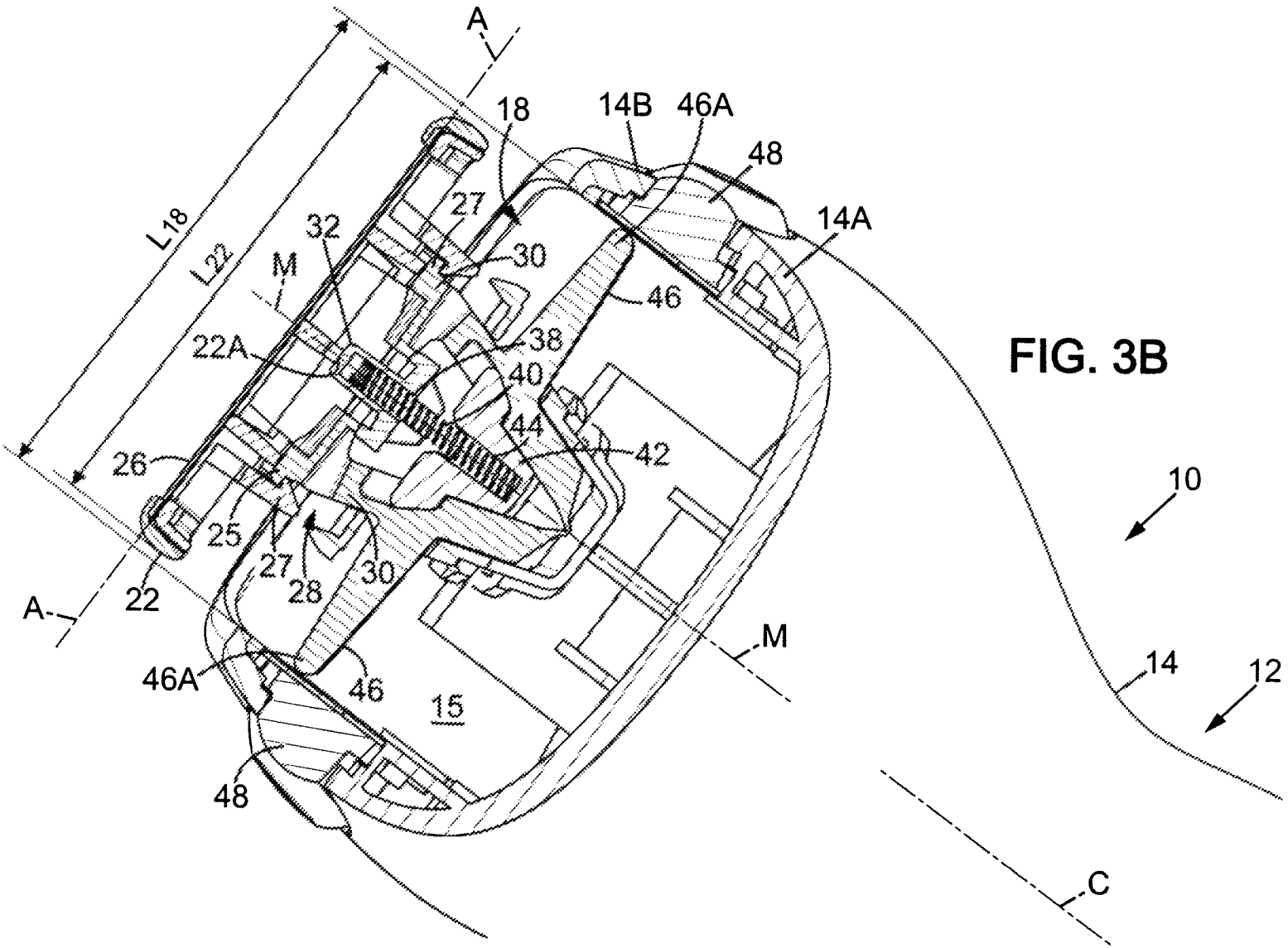
FIG. 3B is a partial cross-sectional view of the front end of the shaving razor shown in FIG. 1B along line IIIB-IIIB.

More specifically, and as best seen in FIGS. 3A and 3B, the opening 18 has a length L18 taken along this transversal axis A-A which is sufficient to accommodate the shaving cartridge 22 with the blade edge 26A in the transversal axis A-A. The length L18 is greater than the length L22 of the shaving cartridge 22 taken along the transversal axis A-A. For example, L18 may be greater than the length L22 by about 5% to 15%, preferably by about 10%.

The shaving cartridge 22 is preferably pivotably mounted on the cartridge carrier 24 for instance by well-known methods such as shell-bearings 25 provided on the free ends of two arms 30 extending forward on the cartridge carrier 24 and which may be connected to corresponding rearwardly protruding connectors 27 shaped arcuate and provided on the shaving cartridge 22. This connection may be of any other known type and is not necessarily detailed here.

Figure 3C:
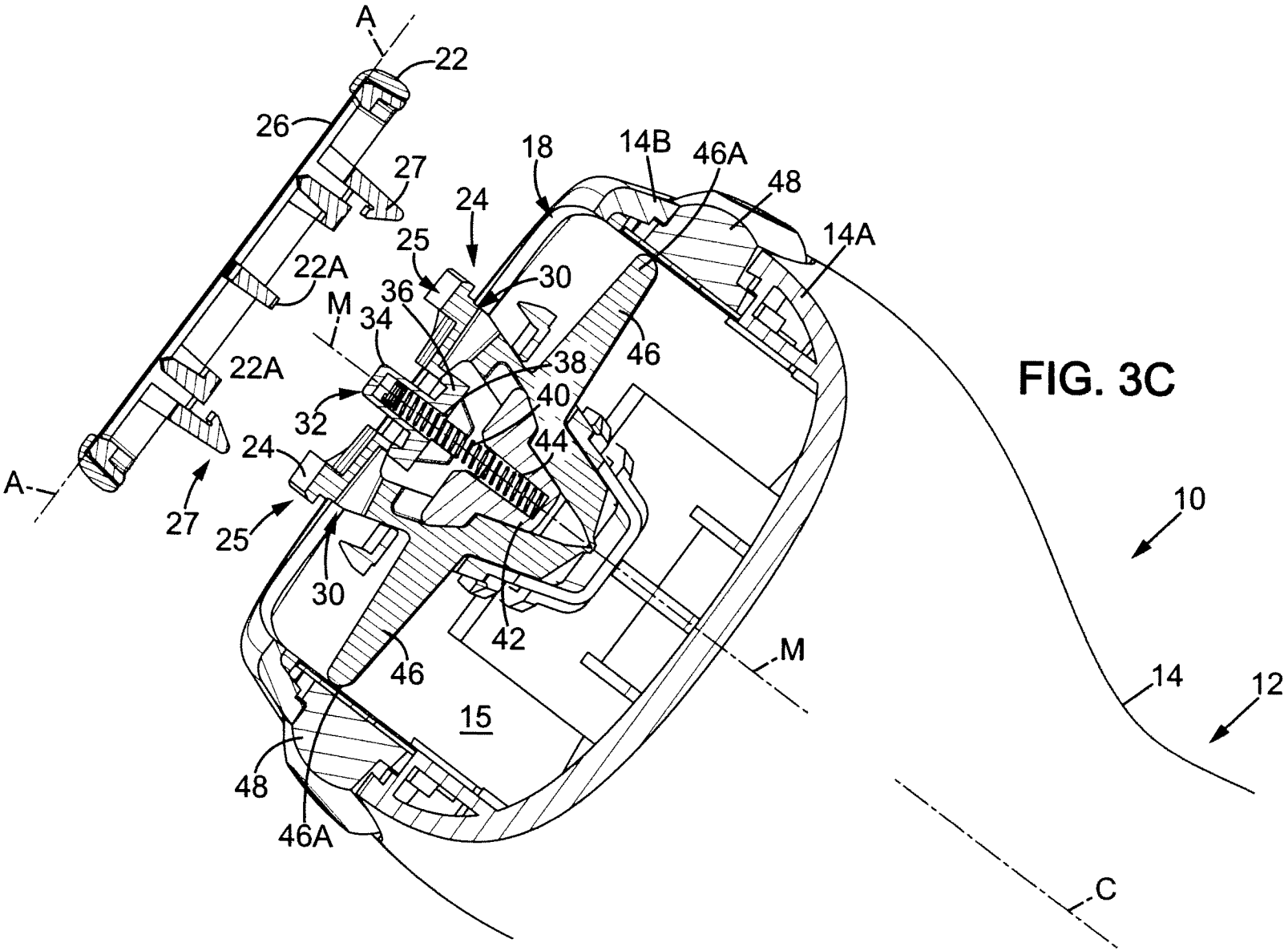
FIG. 3C is a partial cross-sectional view of the front end of a shaving razor with the cartridge carrier in the shaving position and the shaving cartridge being released from to the cartridge carrier.

In a preferred embodiment of the present invention, the shaving cartridge 22 is a disposable cartridge detachably connected to the cartridge carrier 24. When the shaving cartridge 22 is retracted inside the housing 15 as illustrated in FIG. 3A, it cannot be released from the cartridge carrier 24, whereas when it is extended outside of the housing as illustrated in FIG. 3B, it can be released from the cartridge carrier 24 as illustrated in FIG. 3C. A lock/release mechanism 28 is further provided on the handle body 14 to connect and release the shaving cartridge 22. The lock/release mechanism 28 can be one of the known lock/release mechanisms used in the prior art.

For example, and as illustrated in FIGS. 3A to 3C, the lock/release mechanism 28 includes a plunger 32 which is movably mounted, substantially along a medial axis M-M between the two arms 30. The plunger 32 has a central body 34 and two lateral wings 36 extending opposite to one another toward the two arms 30. The central body 34 extends longitudinally parallel to the medial axis M-M, and has a free end able to bear against a cam surface 22A of the shaving cartridge 22. A recess 38 hollowed out in the central body 34 forms a blind hole opening at the opposite end of the central body 34, in the direction of the razor handle 12. The plunger 32 is elastically biased toward a cam surface 22A of the shaving cartridge 22 so as to cooperate therewith by a camming action and to bias the shaving cartridge 22 in rotation toward a rest position. The plunger 32 is biased by a helicoidal spring 40, the first end of which is received in the blind hole 38. The lock/release mechanism 28 further comprises an arm pusher 42 provided with a blind hole 44 for receiving the second end of the helicoidal spring 40. The arms 30 are hinged together and further provided with two lateral extensions 46 extending opposite to one another.

The arm pusher 42 cooperates via a camming action with the two arms 30 for biasing the arms 30 outwardly away from each other and toward a cartridge locking position shown in FIG. 3A, where the shell bearings 25 penetrate in the corresponding arcuate lateral wings 27.

Each of the lateral extensions 46 has a free end 46A which is located in front of an actuating member, more precisely in front of corresponding buttons 48 mounted on the handle body 14, when the cartridge carrier 24 is in the shaving position (see, e.g., FIG. 3B or 3C). In the shaving position, when a pressure is applied to these buttons 48, the lateral extensions 46 are brought together and the arm pusher 42 slides forward in the direction of the shaving cartridge 22 via a camming action. The arms 30 are then brought together in a cartridge release position (not illustrated) and the shaving cartridge 22 is released due to the pressure exerted by the plunger 32. When the pressure exerted on the buttons 48 is released, the arm pusher 42 slides rearward in the direction of the back of the razor handle 12 and the arms 30 are brought outwardly away from each other.

Because of the dispositions described herein, the same spring 40 is used to bias the plunger 32 elastically toward the cam surface 22A of the shaving cartridge 22 and to bias the arm pusher 42 away from the shaving cartridge 22, thus biasing both the shaving cartridge 22 in rotation toward the rest position and the arms 30 toward the cartridge lock position.

In an embodiment of the present invention, when the cartridge carrier 24 is in the non-shaving position (see FIG. 3A), the lateral extensions 46 are not located in front of the buttons 48 such that, even though a pressure is applied to these buttons 48, the lateral extensions cannot been brought together. As a result, the shaving cartridge 22 cannot be released.

The mechanism providing motion of the cartridge carrier 24 shall now be described in detail.

Figure 4A:
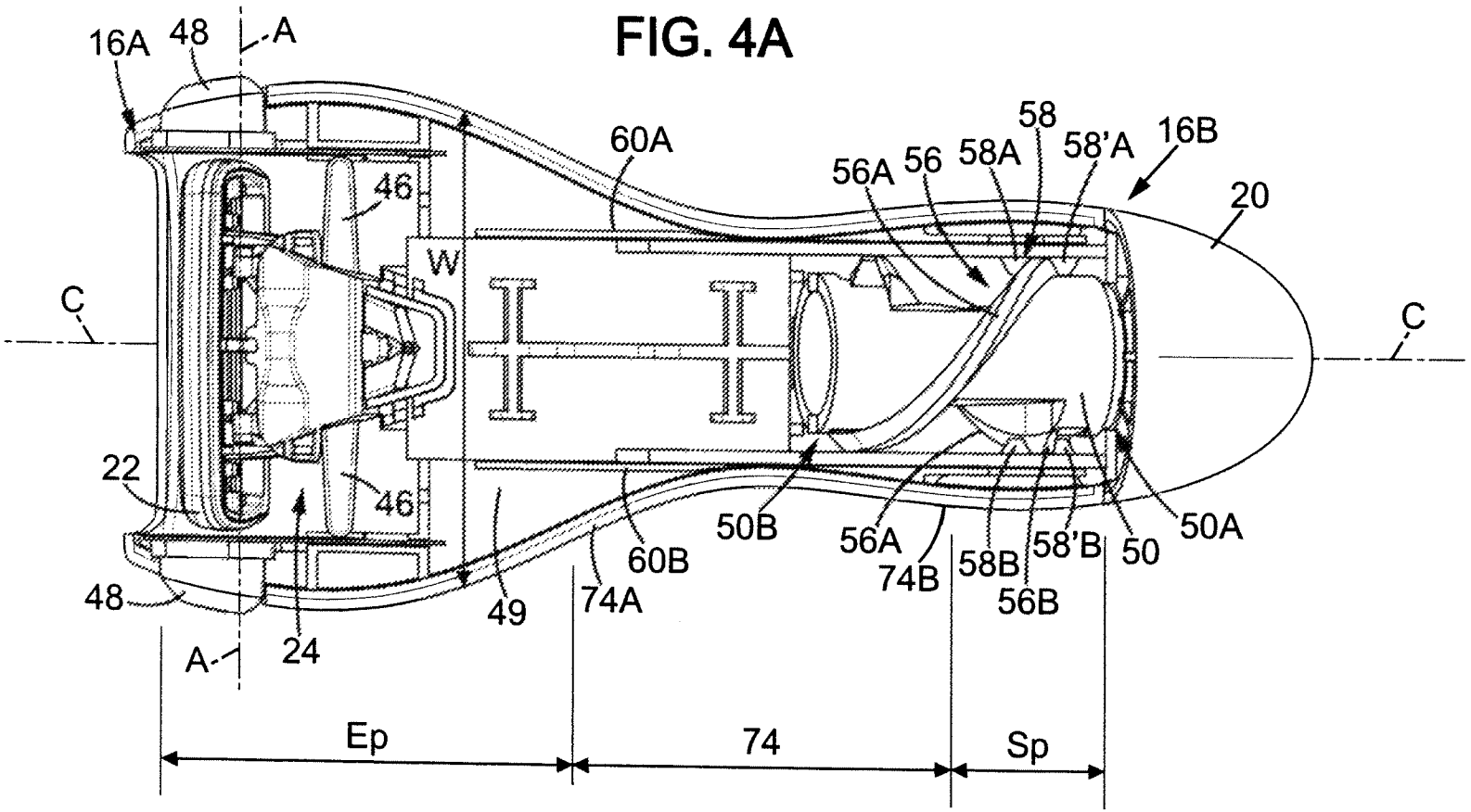
FIG. 4A is an upper view of the shaving razor shown in FIG. 1A with a part of the handle body being released.

As illustrated in FIG. 4A, the razor handle 12 is further provided with a transmission mechanism 49 adapted to convert the rotation of the actuator 20 into a sliding of the cartridge carrier 24.

Figure 6:
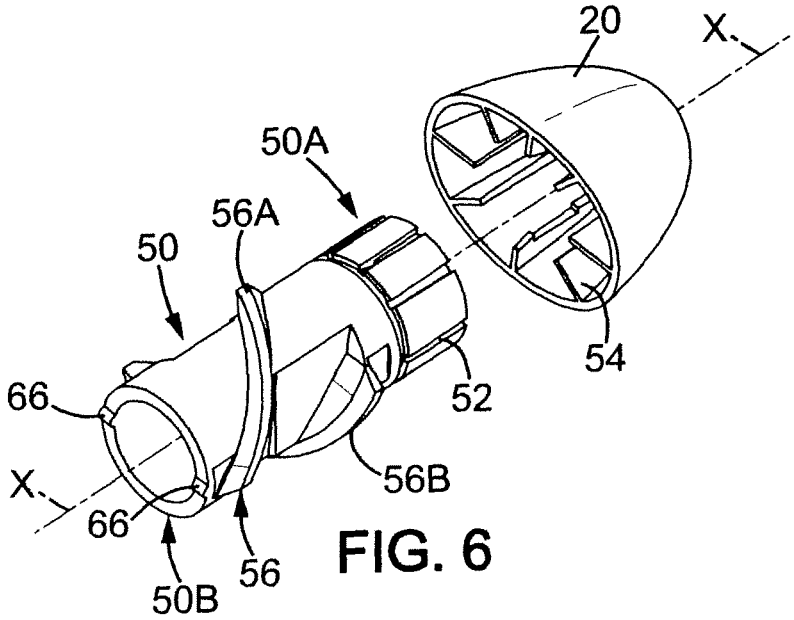
FIG. 6 is a perspective exploded view of zone VI of FIG. 5.

As best seen in FIG. 6, a drum 50 located inside the handle body 14 is fixedly connected to the actuator 20, for instance by serrations 52 provided on the rear free end 20A of the drum 50 that fit into corresponding ribs 54 provided on the internal face of the actuator 20. As a result, the serrations 52 are not visible after assembly, and the actuator 20 is mounted on the drum 50 and located outside of the handle body 14. The actuator 20 and the drum 50 are also rotatably connected to the back end 16B of the handle body 14.

Two support bows 21 are preferably provided on the back end 16B of the upper shell 14A and the lower shell 14B to lockingly mount the set of the actuator 20 and the drum 50 on the handle body 14. Two other support bows 23 may also be provided on the upper shell 14A and the lower shell 14B to support the front end 50B of the drum 50. These bows 21, 23 form a kind of cradle supporting the set of the actuator 20 and the drum 50 and maintain it in the handle body 14 such that it can rotate with regards to the handle body 14.

The transmission mechanism 49 includes a cam belonging to either the drum 50 or the cartridge carrier 24, and a cam-follower belonging to the other of said drum 50 and said cartridge carrier 24. For example, as illustrated in the Figures, a cam 56 may be provided on the drum 50 and a cam-follower 58 may be provided on the cartridge carrier 24.

Figure 4B:
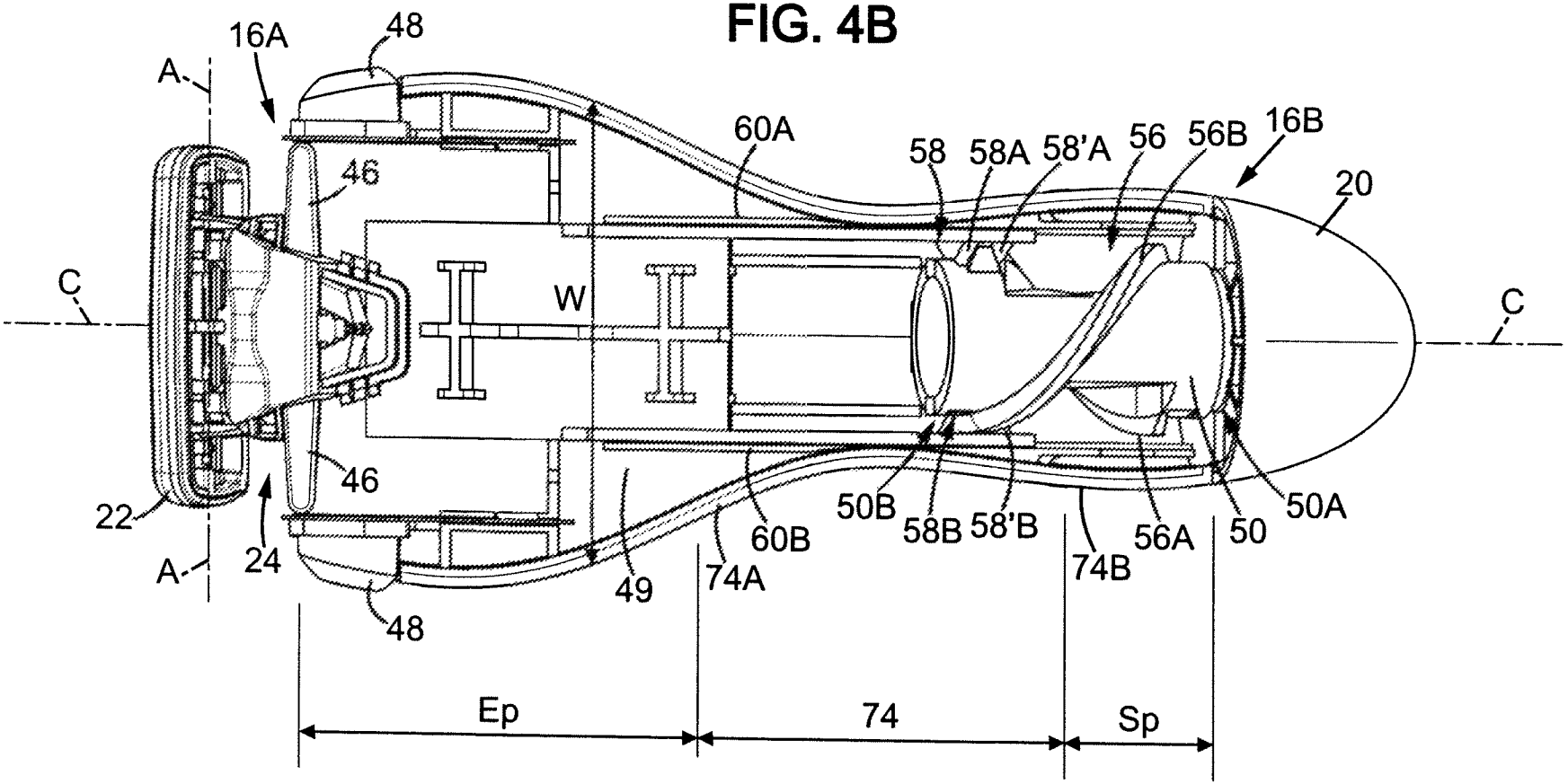
FIG. 4B is an upper view of the shaving razor shown in FIG. 1B with a part of the handle body being released.
Figure 5:
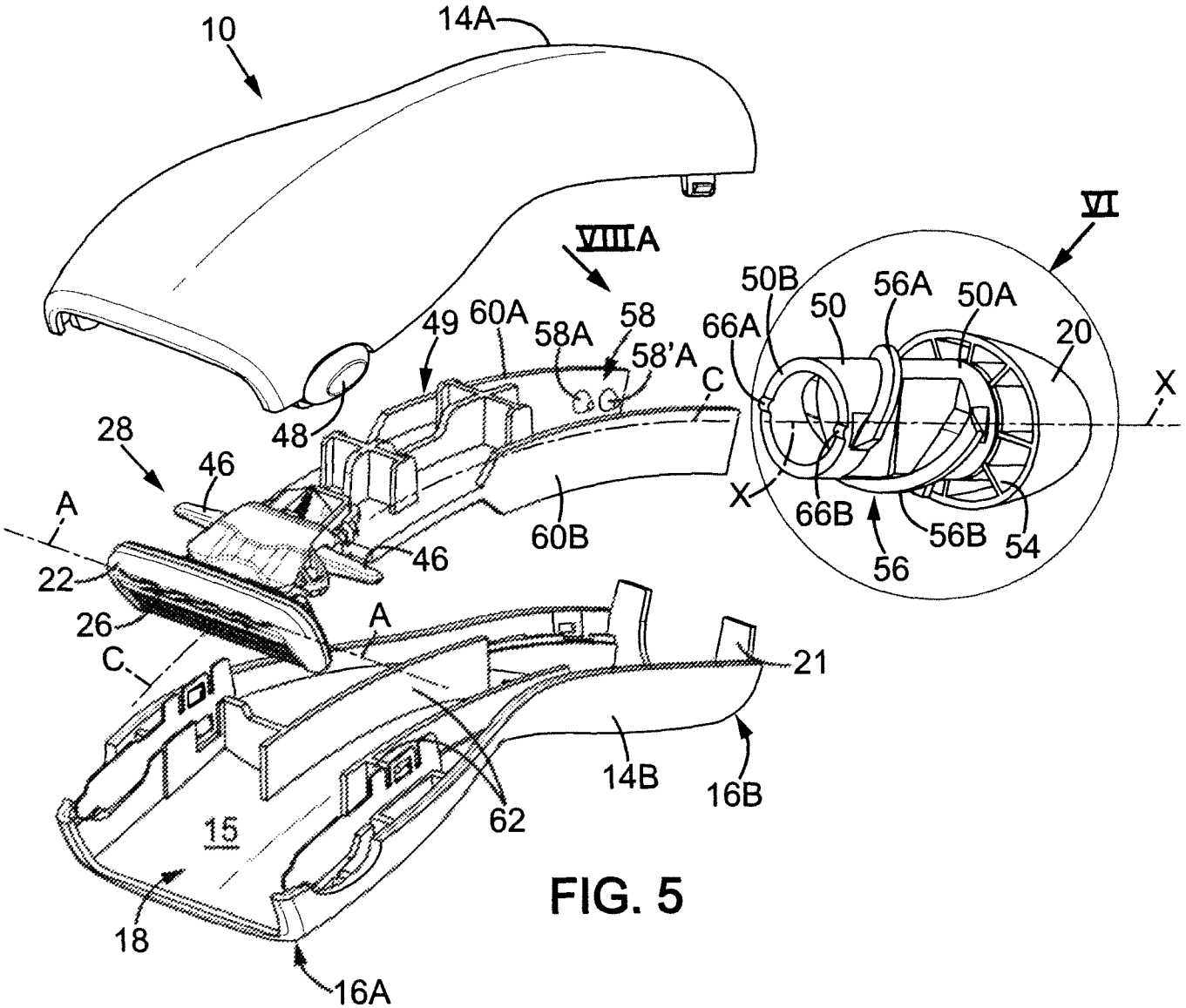
FIG. 5 is a perspective view partially exploded of the razor shown in FIG. 1A.

In reference to FIGS. 4A, 4B and 5, the cartridge carrier 24 is provided with two lateral legs 60A and 60B extending longitudinally in the longitudinal direction C-C and located symmetrically with regard to the longitudinal direction C-C. The lateral legs 60A and 60B are slidingly engaged in the handle body 14, for instance in longitudinal carrier rails 62 provided on the lower shell 14B and on the upper shell 14A (see FIG. 10) further preventing the cartridge carrier 24 from pivoting in the handle body 14. Each of the lateral legs 60A and 60B is provided with a pair of protrusions 58A and 58'A, respectively 58B and 58'B, forming the cam-follower 58.

The cam 56 is provided with at least two opposed threads 56A and 56B extending helicoidally on the outer face of the drum 50 almost from the front end 50B (opposite the rear end 50A) to the serrations 52.

The at least two protrusions of each lateral leg are slidingly engaged against at least one of said threads. More precisely, considering lateral leg 60A, the at least two protrusions 58A and 58'A are slidingly engaged against the thread 56A as illustrated in FIGS. 4A and 4B. Similarly, with the opposite lateral leg 60B, the at least two protrusions 58B and 58'B are slidingly engaged against the thread 56B as illustrated on FIGS. 4A and 4B. The transmission mechanism 49, which includes the drum 50 and the cartridge carrier 24, may form a worm drive transforming the rotary motion of the actuator 20 into a translational movement of the cartridge carrier 24.

Figure 7A:
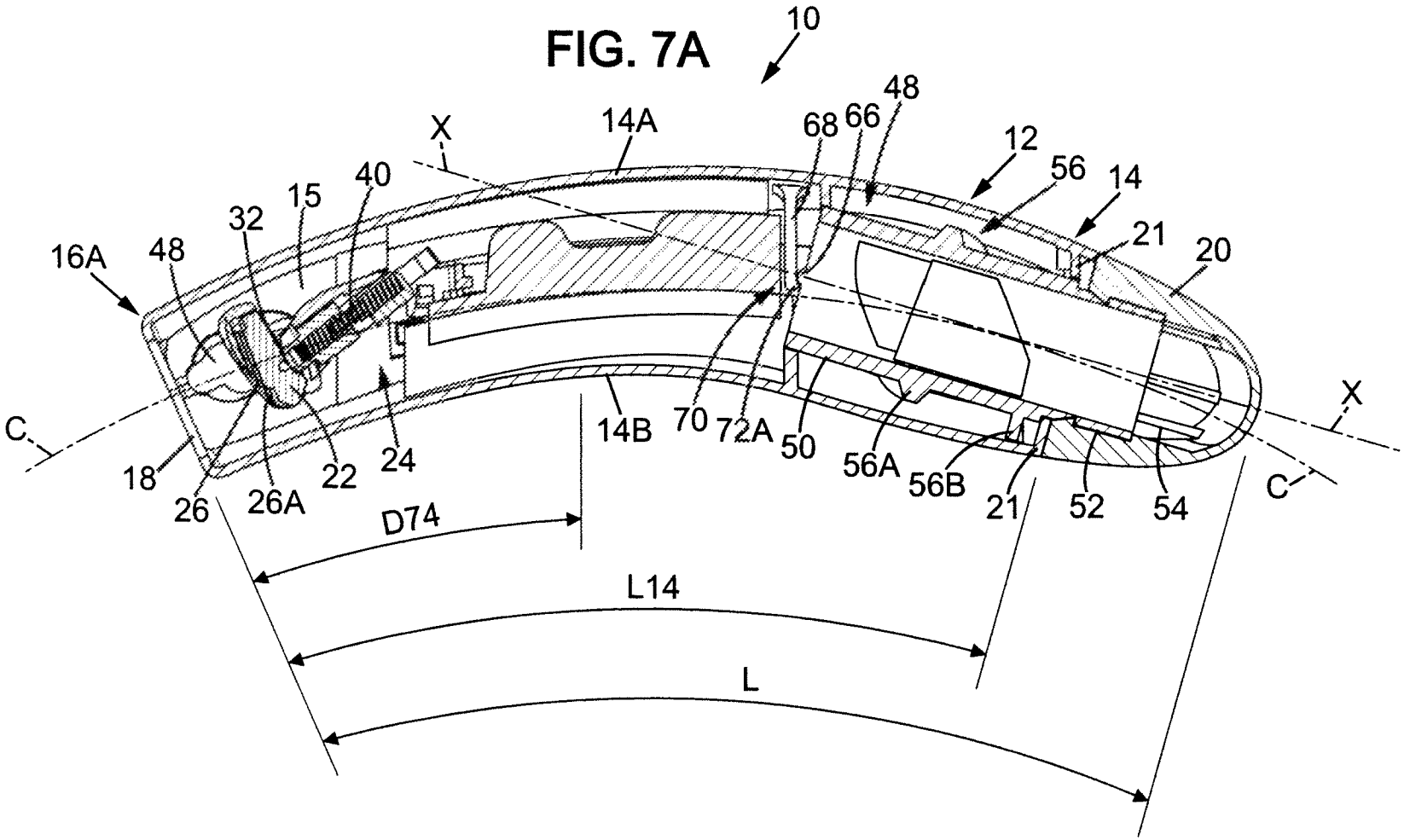
FIG. 7A is a longitudinal section of the shaving razor shown in FIG. 1A along line VIIA-VIIA.
Figure 7B:
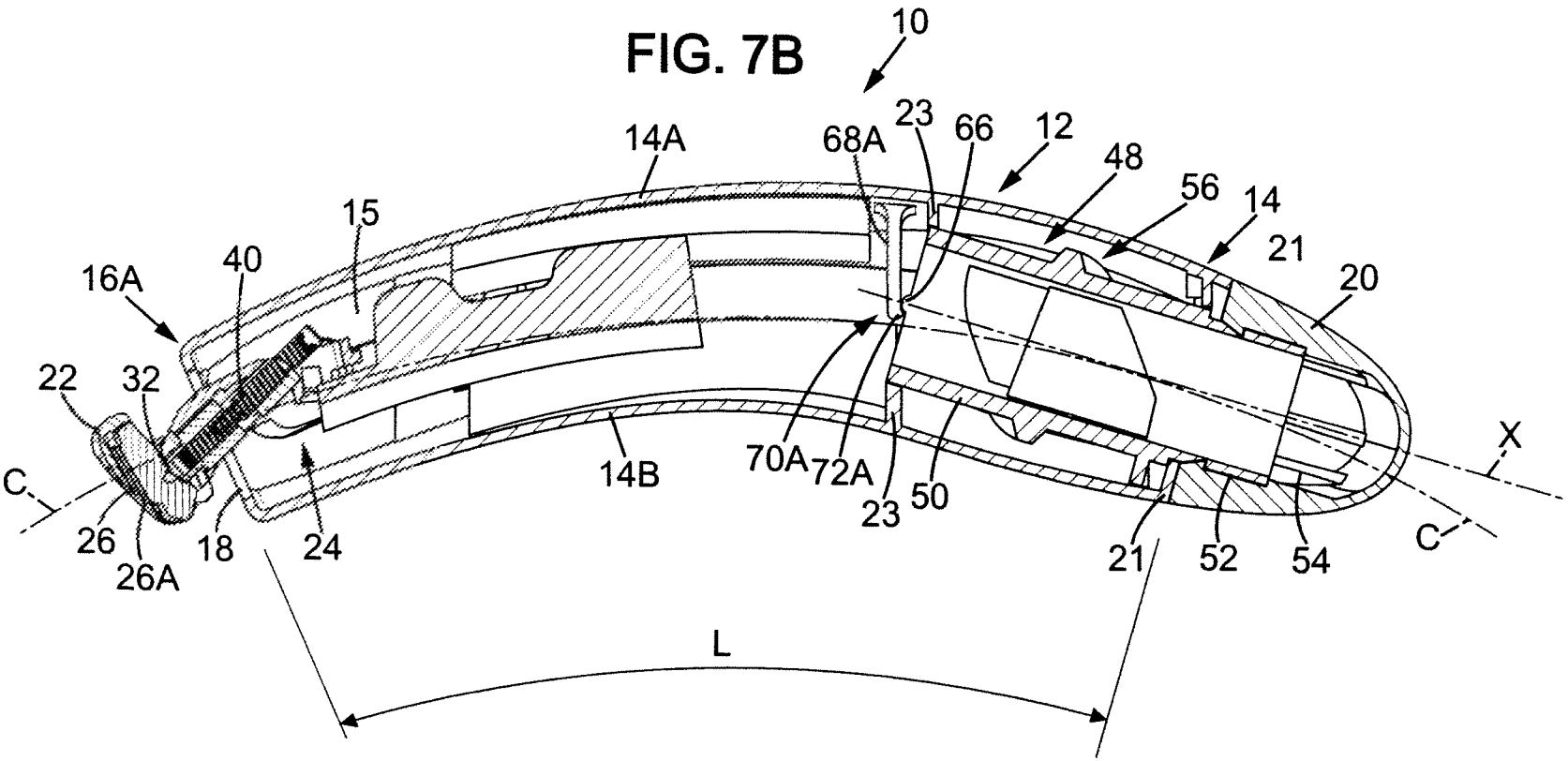
FIG. 7B is a longitudinal section of the shaving razor shown in FIG. 1B along line VIIB-VIIB.

For ergonomic reasons, the handle body 14 may be continuously curved as best seen in FIGS. 7A and 7B along the longitudinal direction C-C (which is not rectilinear, but curved). Due to this curvature and the fact that the drum 50 is an axisymmetric cylinder coaxially located about a pivot axis X-X (rectilinear), when the actuator 20 is turned, the drum rotates about the pivot axis X-X and not about the longitudinal direction C-C. Therefore, because the drum 50 is located between the lateral legs 60A and 60B, when the actuator 20 is turned, the drum 50 rotates about the pivot axis X-X such that the at least two threads 56A and 56B also rotate about the pivot axis X-X; as a result, the two pairs of protrusions, respectively 58A and 58'A and 58B and 58'B, are moving along the longitudinal direction C-C sliding the cartridge carrier 24 along the longitudinal direction C-C. Therefore, and in order to compensate the deviation between the pivot axis X-X and the longitudinal direction C-C, the threads have a pitch that is different from one thread to the other, further variable along the longitudinal direction C-C.

Figure 8A:
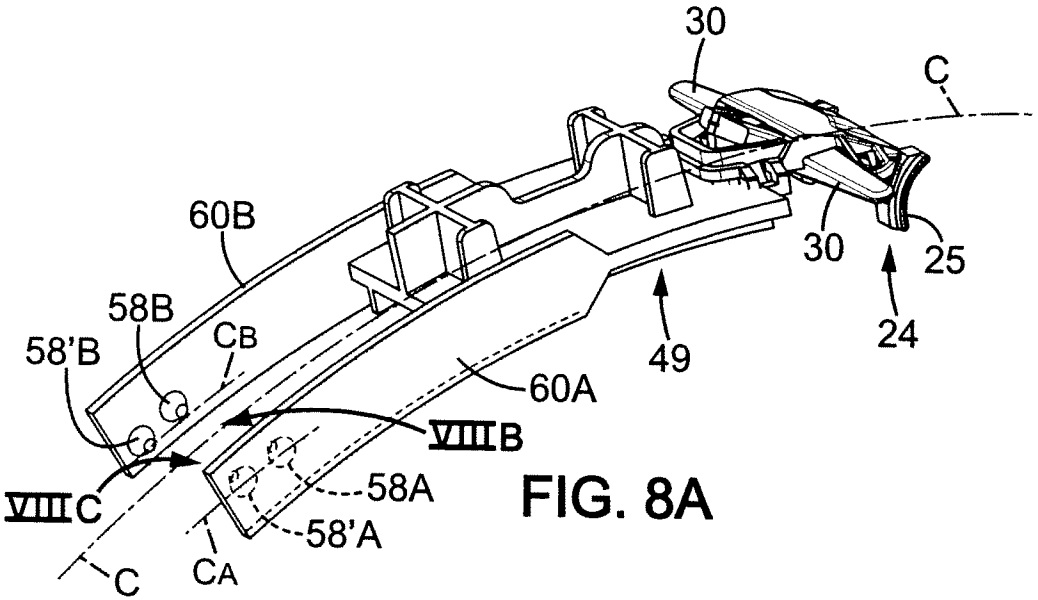
FIG. 8A is a perspective view of the cartridge carrier and the transmission mechanism shown in FIG. 5, seen along arrow VIII.
Figure 8B:
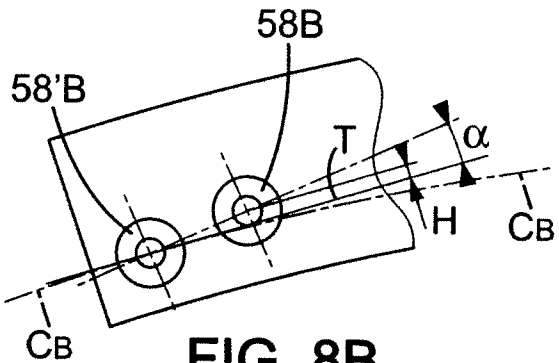
FIG. 8B is a perspective partial view of the transmission mechanism shown in FIG. 5 seen along arrow VIIIB.
Figure 8C:
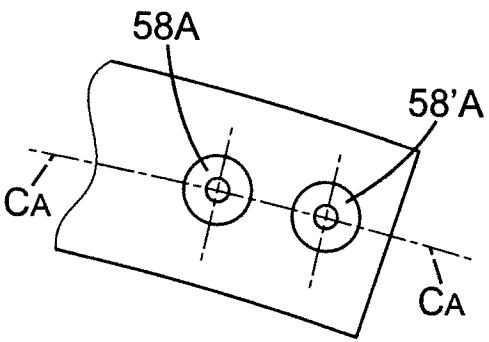
FIG. 8C is a perspective partial view of the transmission mechanism shown in FIG. 5 seen along arrow VIIIC.

With reference to FIGS. 8A to 8C, in order to maintain a constant engagement of the protrusions against the threads, especially when forces are applied against the shaving cartridge 22 during shaving, the protrusions of one pair is asymmetric with regard to the other pair. More precisely, the protrusions 58A and 58'A of the lateral leg 60A are continuously aligned with the longitudinal direction CA-CA parallel to the longitudinal direction C-C (see also FIGS. 9A and 9B), whereas the protrusions 58B and 58'B of the opposite lateral leg 60B are deviated with regard to the longitudinal direction CB-CB parallel to the longitudinal direction C-C of an angle α, the protrusion 58'B being aligned with the longitudinal direction CB-CB and the protrusion 58B being distant from the longitudinal direction CB-CB. For instance, according to the curvature of the handle body 14, the angle α can have a value comprised between 0° and 30° with respect to the tangent T to the longitudinal direction CB-CB passing through the protrusion 58'B. In a preferred embodiment of the present invention the angle α is about 8°. The corresponding tilt H of the position of the protrusion 58'B has a height of about 2 mm to 10 mm with regards to the tangent T. In a preferred embodiment of the present invention the height is about 5 mm.

Figure 9A:
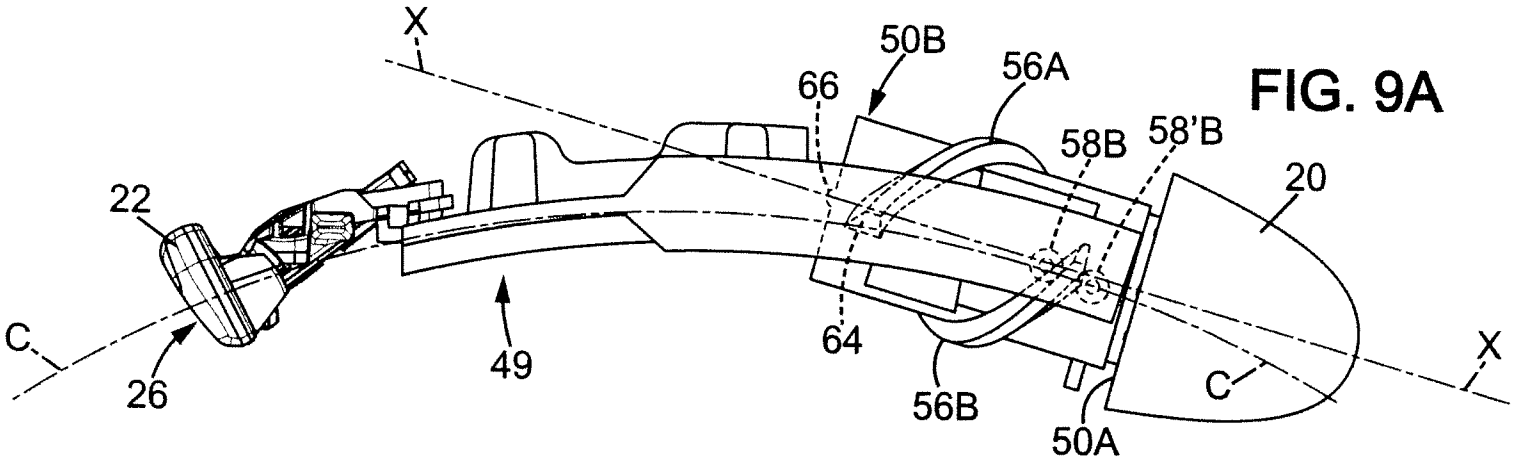
FIG. 9A is a longitudinal section of the shaving razor shown in FIG. 7A without the handle body.
Figure 9B:
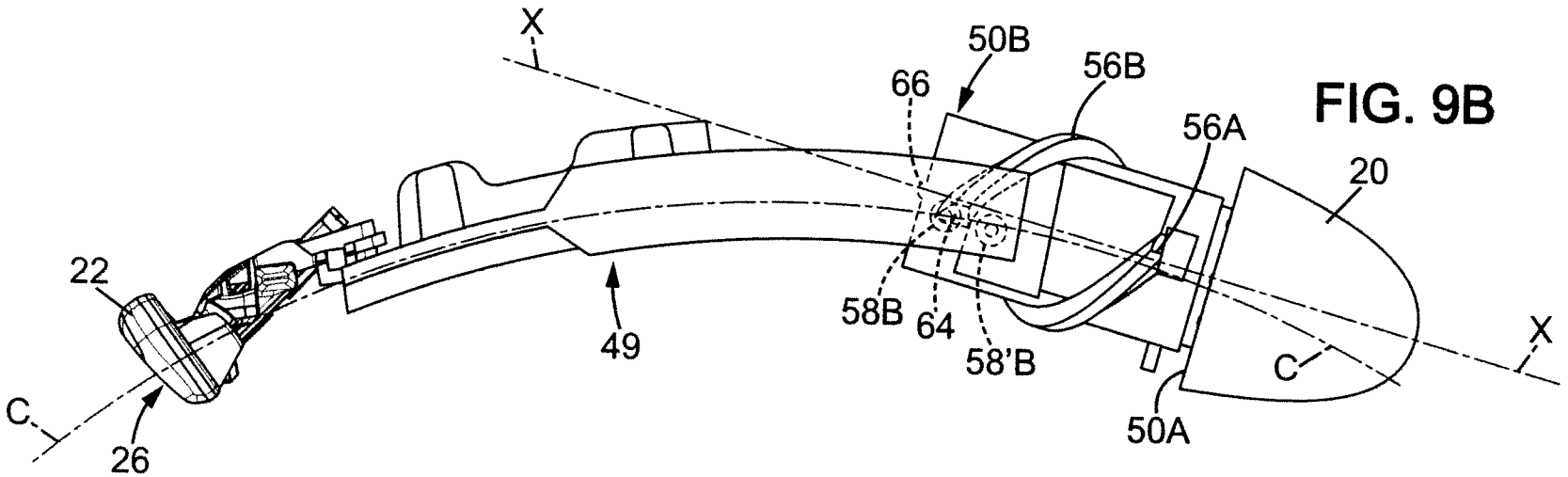
FIG. 9B is a longitudinal section of the shaving razor shown in FIG. 7B without the handle body.

As best seen in FIGS. 9A and 9B, the threads have a sudden decrease 64 at the front end 50B of the drum 50 such that when shaving, any translation of the cartridge carrier 24 leading to a rotation of the drum 50 is prevented with the pressure angle and friction induced.

Figure 10:
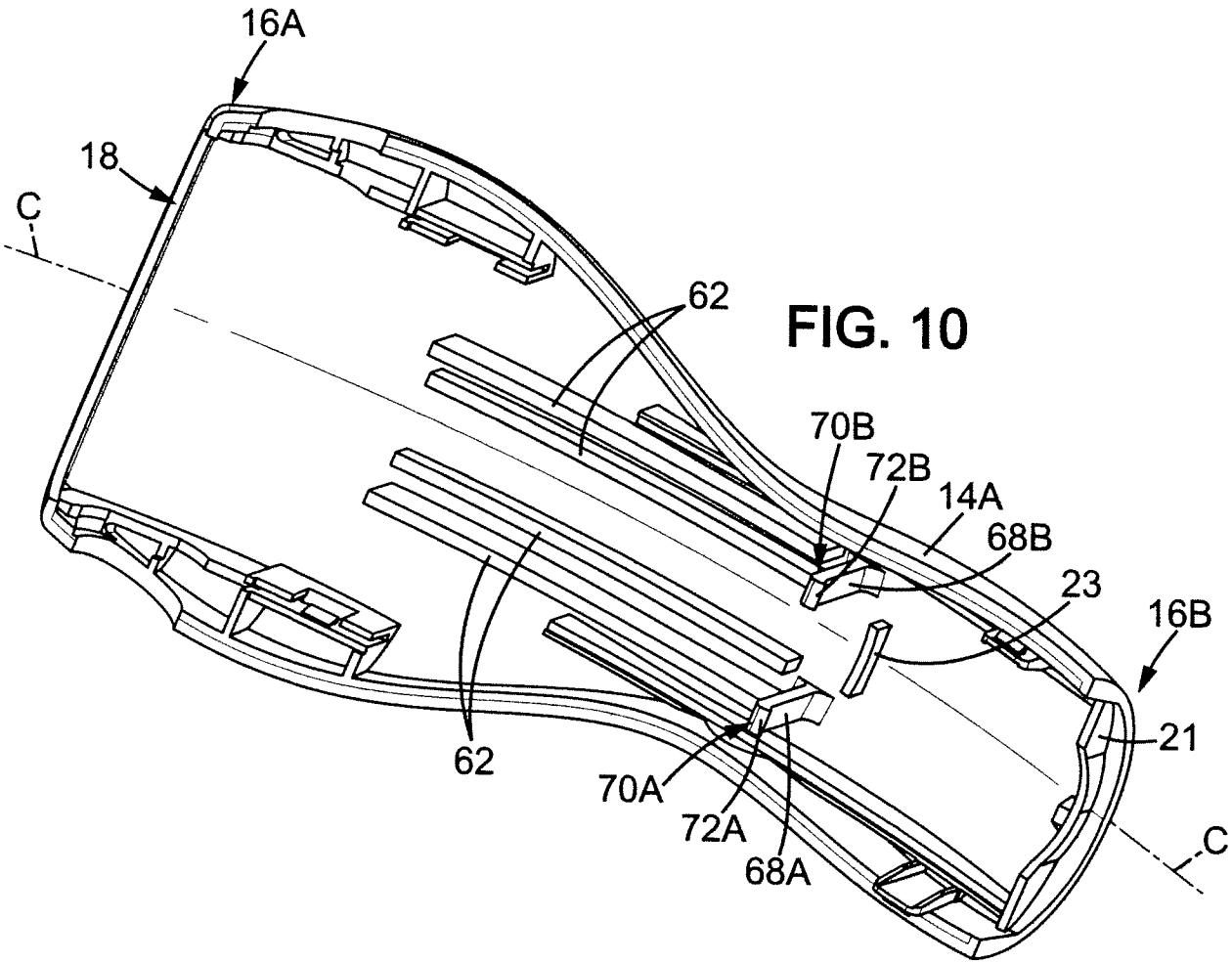
FIG. 10 is a perspective view of the upper shell of the handle body, according to an embodiment of the present invention.

As illustrated in FIGS. 5, 6 7A and 7B, in order to provide a tactile ergonomic feedback, the drum 50 is further provided with at least two spigots 66A and 66B located diametrally opposed at the front end 50B, and which can engage against at least two corresponding leaf springs 68A and 68B further provided on the handle body 14. As best illustrated in FIG. 10, each leaf spring extends from the upper shell 14A on both sides of the longitudinal direction C-C in the direction of the longitudinal direction C-C.

Due to the curvature of the handle body 14, when the actuator 20 is turned, the leaf springs 68A and 68B flex away from their rest position (illustrated in the Figures) by the relative movement of the spigots 66. The bending of the leaf springs provides some resistance to the movement of the drum 50 leading to tactile ergonomic feedback for the user.

In order to prevent rotation beyond the desired angle, i.e., below 0°, beyond 180° or 360°, each leaf spring 68A, 68B includes at its free end 70A, 70B a bulge 72A, 72B against which the spigots 66A and 66B stop.

Due to the worm drive formed by the drum 50 and the cartridge carrier 24, the razor according to an embodiment of the present invention can allow a half-rotation of 180° as described above, and in that case, the user turns the actuator 20 in the one direction to move the cartridge carrier 24 from its non-shaving position (as illustrated in FIG. 4A) to its shaving position (as illustrated in FIG. 4B) and in the opposite direction to move the cartridge carrier 24 from its shaving position (as illustrated in FIG. 4B) to its non-shaving position (as illustrated in FIG. 4A).

The rotation of the actuator 20 can also be limited to a rotation angle of 90° or extended to an angle of 360° in the A1 direction. In that first case (90°) and as mentioned above for an admissible rotation angle of 180°, according to the direction of rotation of the actuator 20, the cartridge carrier 24 is pushed forward in direction of the front end 16A of the handle body 14 (as illustrated in FIG. 4B) or is pulled rearward in the direction of the back end 16B of the handle body 14 to its non-shaving position (as illustrated in FIG. 4A). In the latter case (admissible rotation of 360°), the direction of displacement of the cartridge carrier 24 depends on its previous position and not of the direction of rotation of the actuator 20. Whether the user turns the actuator 20 in one direction (A1) or in the opposite direction (A2), the cartridge carrier 24 is pushed forward or is pulled rearward, solely on the basis of its starting position. The user can turn the actuator 20 in the same direction to move the cartridge carrier 24 from its non-shaving position (as illustrated in FIG. 4A) to its shaving position (as illustrated in FIG. 4B), and vice-versa.

End stops (not illustrated) can be further provided on the drum 50 to cooperate with end stops (not illustrated) provided on the upper and lower shells to prevent any excess rotation beyond the normal operating angles.

In reference to FIGS. 4A-4B and 7A-7B, the elongate handle body 14 may define a variable width W along the length L14 thereof, the length L14 being taken along the longitudinal direction C-C. More precisely, the handle body 14 comprises an enlarged part Ep with respect to said width W and a slim part Sp with respect to said width W, connected together by a neck 74. The enlarged part Ep extends from the neck 74 to the front end 16A, whereas the slim part Sp extends from neck 74 to the back end 16B.

Due to the geometry of the body, the neck 74 also has a variable width, with the wider side 74A of the neck 74 being adjacent to the enlarged part Ep, and the narrow side 74B of the neck 74 being adjacent to the slim part Sp. The wider side 74A of the neck 74 is preferably located at a distance D74 from the front end 16A that is between 20% and 50% of an overall length L of the razor handle 12, preferably located at about 30%. In an embodiment of the present invention, the length L of the razor handle 12 is preferably between 100 mm and 180 mm, the wider side 74A of neck 74 is preferably located between 40 mm to 90 mm from the front end 16A, and the neck 74 has a length L74 between 30 mm and 60 mm. For example, with a length L of the razor handle 12 being about 140 mm, the wider side 74A of neck 74 is located at about 50 mm, and the neck 74 has a length L74 of about 40 mm. The razor handle 12 may also be a little bit longer and have a length L of about 150 mm; in this case, the wider side 74A of neck 74 is preferably located at about 60 mm and the neck 74 has a length L74 of about 50 mm.

The length L74 of the neck 74 and its widening are chosen according to the widths of the enlarged part Ep and the slim part Sp such that the connection between the neck 74, the enlarged part Ep, and the slim part Sp has a smooth curvature.

In the embodiments of the invention as described above, the shaving cartridge is always in a good position to shave. Therefore, when the user extends the shaving cartridge out of the razor handle, the user can directly shave without having to turn the shaving cartridge before shaving. In the same way, when the user wants to store the shaving cartridge in the razor handle, the user can also directly retract the shaving cartridge in the razor handle without having to turn the shaving cartridge before. Therefore, the use of the razor as described by the embodiments of the present invention is simpler and further, the user has less risk to cut themselves when handling the razor, especially when moving the shaving cartridge between its positions (i.e., extended and retracted, corresponding respectively the shaving and non-shaving positions).

As discussed above, in various embodiments of the present invention, one and/or the other of the following features may be incorporated:

- the actuator is able to be turned in the same direction for controlling cartridge carrier motions;
- the actuator is able to be turned in one direction to move the cartridge carrier between the shaving position and the non-shaving position and is able to be turned in the opposite direction to move the cartridge carrier between the non-shaving position and the shaving position, and vice-versa;
- a drum is fixedly connected to the actuator and the transmission mechanism includes a cam belonging to either the drum or the cartridge carrier, and a cam-follower belonging either the drum or the cartridge carrier not having the cam;

the drum and the cartridge carrier form a worm drive;

the cam-follower includes at least one protrusion belonging to the cartridge carrier and the cam includes at least one thread provided on the drum, the protrusion being slidingly engaged with the thread;

the cartridge carrier is provided with at least two lateral legs, each provided with at least two protrusions, and the drum is provided with at least two threads, at least two protrusions of each lateral leg being slidingly engaged against at least one of the threads, the lateral legs extending in the longitudinal direction and the drum being located between the lateral legs;

the cartridge carrier comprises at least two arms extending forward and having free ends respectively cooperating with at least two rearwardly protruding connectors provided on the shaving cartridge for mounting the shaving cartridge on the cartridge carrier;

the at least two arms extend substantially symmetrically on both sides of a medial axis, the arms being elastically biased opposite to one another toward a cartridge locking position in which the shaving cartridge is able to be locked on the razor handle, and the arms are movable toward one another into a cartridge release position in which the shaving cartridge is able to be released from the razor handle;

the razor further comprises a lock/release mechanism provided on the cartridge carrier;

the lock/release mechanism including the at least two arms, a plunger which is movable between the at least two arms (substantially parallel to said medial axis), a spring biasing the plunger away from the handle body such that the plunger is adapted to cooperate with a cam surface belonging to the shaving cartridge for biasing the shaving cartridge toward a rest position, and an arm pusher which is movable substantially parallel to the medial axis and which is biased toward the handle body by the spring, the arm pusher cooperating with the at least two arms via a camming action for biasing the arms toward the cartridge locking position; and the handle body has a length along the longitudinal direction and a variable width along the length, the body including an enlarged part with respect to the width and a slim part with respect to the width, with the enlarged and slim parts being connected together by a neck, the neck being located at a distance from the front end which is comprised between 10% and 20% of an overall length of the razor handle, the enlarged part extending from this neck to the front end, wherein the slim part extends from the back end to the neck.

An embodiment of the present invention also includes a razor handle with a lock/release mechanism provided on the cartridge carrier and including an actuating member which is adapted to actuate the lock/release mechanism so as to release a shaving cartridge carried by the cartridge carrier.

In various embodiments of the present invention of such a razor handle, one and/or the other of the following features may be incorporated:

at least two arms extending forward and having free ends respectively cooperating with at least two rearwardly protruding connectors provided on a shaving cartridge for mounting a shaving cartridge on the cartridge carrier;

the at least two arms extend substantially symmetrically on both sides of a medial axis, the arms being elastically biased opposite to one another toward a cartridge locking position in which a shaving cartridge is able to be locked on the razor handle, and the arms are movable toward one another into a cartridge release position in which a shaving cartridge is able to be released from the razor handle;

the lock/release mechanism including the at least two arms, a plunger which is movable between the at least two arms (substantially parallel to said medial axis), a spring biasing the plunger away from the handle body, such that the plunger is adapted to cooperate with a cam surface belonging to the shaving cartridge for biasing the shaving cartridge toward a rest position, and an arm pusher which is movable substantially parallel to the medial axis and which is biased toward the handle body by the spring, the arm pusher cooperating with the at least two arms via a camming action for biasing the arms toward the cartridge locking position;

the cartridge carrier is slidably mounted on the handle body;

a drum is fixedly connected to the actuator and the transmission mechanism includes a cam belonging to either the drum or the cartridge carrier, and a cam-follower belonging to either the drum or the cartridge carrier not having the cam;

the drum and the cartridge carrier form a worm drive;

the cam-follower includes at least one protrusion belonging to the cartridge carrier and the cam includes at least on thread provided on the drum, the protrusion being slidingly engaged against the thread; and the cartridge carrier is provided with at least two lateral legs, each provided with at least two protrusions, and the drum is provided with at least two threads, at least two protrusions of each lateral legs being slidingly engaged against one of the threads, the lateral legs extending in the longitudinal direction and the drum being located between the lateral legs.

An embodiment of the present invention also includes a razor with a razor handle and a shaving cartridge connected to the cartridge carrier that includes at least one blade having a blade edge extending along a transversal axis perpendicular to the longitudinal direction of the razor handle.

An embodiment of the present invention can have the shaving cartridge connected to the cartridge carrier such that the shaving cartridge extends out of the razor handle when the cartridge carrier is in the shaving position and the shaving cartridge is located inside the housing when the cartridge carrier is in the non-shaving position, and the lock/release mechanism can be adapted to release the shaving cartridge only when the cartridge carrier is in said shaving position.

The opening of the housing of an embodiment of the present invention can be elongated and can extend along the transversal axis, the opening having a length which is sufficient to accommodate the shaving cartridge with the blade edge in the transversal axis and while in both the shaving and non-shaving positions, as well as during the motion of the shaving cartridge between those two positions, the shaving cartridge extends parallel to the transversal axis.

The invention claimed is:

1. A razor comprising:

an elongated shaving cartridge comprising at least one blade having a blade edge extending along a transversal axis; and a razor handle, the razor handle comprising:

a handle body extending in a longitudinal direction between a front end and a back end, the handle body having a hollow housing provided with an opening at the front end of the handle body, the longitudinal direction being perpendicular to the transversal axis, a cartridge carrier carrying the shaving cartridge and being slidably mounted on the handle body between a shaving position in which the shaving cartridge extends at least partly out of the housing, and a non-shaving position in which the shaving cartridge is retracted inside of the housing, an actuator rotatably mounted on the handle body for controlling cartridge carrier motions, and a transmission mechanism adapted to convert a rotation of the actuator into a sliding of the cartridge carrier;

wherein the opening is elongated, extends along the transversal axis, and has a length which is sufficient to accommodate the shaving cartridge with the blade edge extending along the transversal axis, wherein in the shaving and non-shaving positions, and during a motion of the shaving cartridge between the shaving and non-shaving positions, the shaving cartridge extends parallel to the transversal axis, wherein a drum is fixedly connected to the actuator and wherein the transmission mechanism includes a cam belonging to either the drum or the cartridge carrier and a cam-follower belonging to either the drum or the cartridge carrier not including the cam, and wherein the cam-follower includes at least one protrusion belonging to the cartridge carrier and the cam includes at least one thread provided on the drum, the protrusion being slidingly engaged with the thread.

2. The razor according to claim 1, wherein the actuator is able to be turned in the same direction for controlling cartridge carrier motions.

3. The razor according to claim 1, wherein the actuator is able to be turned in one direction to move the cartridge carrier between the shaving position and the non-shaving position, and the actuator is able to be turned in an opposite direction to move the cartridge carrier between the non-shaving position and the shaving position.

4. The razor according to claim 1, wherein the drum and the cartridge carrier form a worm drive.

5. The razor according to claim 1, wherein the cartridge carrier comprises at least two lateral legs, each including at least two protrusions, and the drum comprises at least two threads, the at least two protrusions of each lateral leg being slidingly engaged with at least one of the threads of the drum, the lateral legs extending in the longitudinal direction and the drum being located between the lateral legs.

6. The razor according to claim 1, wherein the cartridge carrier comprises at least two arms extending forward substantially symmetrically on both sides of a medial axis and having free ends respectively cooperating with at least two rearwardly protruding connectors provided on the shaving cartridge for mounting the shaving cartridge on the cartridge carrier, the arms being elastically biased opposite to one another toward a cartridge locking position in which the shaving cartridge is able to be locked on the razor handle, and the arms being movable toward one another into a cartridge release position in which the shaving cartridge is able to be released from the razor handle.

7. The razor according to claim 6, further comprising a lock/release mechanism provided on the cartridge carrier, the lock/release mechanism comprising:

the at least two arms, a plunger movable between the at least two arms, substantially parallel to the medial axis, a spring biasing the plunger away from the handle body such that the plunger is adapted to cooperate with a cam surface belonging to the shaving cartridge for biasing the shaving cartridge toward a rest position, and an arm pusher movable substantially parallel to the medial axis and which is biased toward the handle body by the spring, the arm pusher cooperating with the at least two arms by a camming action for biasing the arms toward the cartridge locking position.

8. The razor according to claim 1, wherein the handle body has a length along the longitudinal direction and a variable width along its length, the handle body comprising an enlarged part with respect to the width and a slim part with respect to the width, the enlarged and slim parts being connected together by a neck, the neck being located at a distance from the front end which is between 20% and 50% of an overall length of the razor handle, the enlarged part extending from the neck to the front end, wherein the slim part extends from the back end to the neck.

9. A razor handle comprising:

a handle body extending in a longitudinal direction between a front end and a back end, the handle body comprising a hollow housing including an opening at the front end of the handle body, a cartridge carrier adapted to carry a shaving cartridge and movable between a shaving position in which the razor cartridge carrier extends at least partly out of the housing and a non-shaving position in which the razor cartridge carrier is retracted inside the housing, an actuator rotatably mounted on the handle body for controlling cartridge carrier motion, and a transmission mechanism adapted to convert a rotation of the actuator into a sliding of the cartridge carrier, wherein the razor handle further comprises a lock/release mechanism provided on the cartridge carrier, the lock/release mechanism comprising an actuating member which is adapted to actuate a release mechanism so as to release a shaving cartridge carried by the cartridge carrier, wherein a drum is fixedly connected to the actuator and wherein the transmission mechanism includes a cam belonging to either the drum or the cartridge carrier and a cam-follower belonging to either the drum or the cartridge carrier not including the cam, and wherein the cam-follower includes at least one protrusion belonging to the cartridge carrier and the cam includes at least on thread provided on the drum, the protrusion being slidingly engaged with the thread.

10. The razor handle according to claim 9, wherein the cartridge carrier comprises at least two arms extending forward substantially symmetrically on both sides of a medial axis and having free ends respectively cooperating with at least two rearwardly protruding connectors provided on the shaving cartridge for mounting the shaving cartridge on the cartridge carrier, the arms being elastically biased opposite to one another toward a cartridge locking position in which the shaving cartridge is able to be locked on the razor handle, and the arms being movable toward one another into a cartridge release position in which the shaving cartridge is able to be released from the razor handle.

11. The razor handle according to claim 10, wherein the lock/release mechanism further comprises:

the at least two arms, a plunger movable between the at least two arms, substantially parallel to the medial axis, a spring biasing the plunger away from the handle body such that the plunger is adapted to cooperate with a cam surface belonging to the shaving cartridge for biasing the shaving cartridge toward a rest position, and an arm pusher movable substantially parallel to the medial axis and which is biased toward the handle body by the spring, the arm pusher cooperating with the at least two arms by a camming action for biasing the arms toward the cartridge locking position.

12. The razor handle according to claim 9, wherein the cartridge carrier is slidably mounted on the handle body.

13. The razor according to claim 9, wherein the drum and the cartridge carrier form a worm drive.

14. The razor handle according to claim 9, wherein the cartridge carrier comprises at least two lateral legs, each including at least two protrusions, and the drum comprises at least two threads, the at least two protrusions of each lateral leg being slidingly engaged with at least one of the threads of the drum, the lateral legs extending in the longitudinal direction and the drum being located between the lateral legs.

15. The razor handle according to claim 9, wherein the handle body has a length along the longitudinal direction and a variable width along the length, the handle body comprising an enlarged part with respect to the width and a slim part with respect to the width, the enlarged and slim parts being connected together by a neck, the neck being located at a distance from the front end which is between 20% and 50% of an overall length of the razor handle, the enlarged part extending from the neck to the front end, wherein the slim part extends from the back end to the neck.

16. The razor handle according to claim 9, further comprising a shaving cartridge comprising at least one blade having a blade edge extending along a transversal axis perpendicular to the longitudinal direction of the handle body, the shaving cartridge connected to the cartridge carrier such that the shaving cartridge extends out of the razor handle when the cartridge carrier is in the shaving position and the shaving cartridge is located inside the housing when the cartridge carrier is in the non-shaving position, and wherein the lock/release mechanism is adapted to release the shaving cartridge only when the cartridge carrier is in the shaving position.

17. The razor according to claim 16, wherein the opening of the housing is elongated, extends along the transversal axis, and has a length which is sufficient to accommodate the shaving cartridge with the blade edge extending along the transversal axis, wherein in the shaving and non-shaving positions, and during a motion of the shaving cartridge between the shaving and non-shaving positions, the shaving cartridge extends parallel to the transversal axis.

18. The razor according to claim 16, wherein the opening of the housing is elongated, extends along the transversal axis, and has a length which is sufficient to accommodate the shaving cartridge with the blade edge extending along the transversal axis, wherein in the shaving and non-shaving positions, and during a motion of the shaving cartridge between the shaving and non-shaving positions, the shaving cartridge extends parallel to the transversal axis.

* * * * *